United States Patent [19]

Brown et al.

[11] 4,334,335

[45] Jun. 15, 1982

[54] SCRUBBER WITH HYDRAULIC SQUEEGEE LIFT

[75] Inventors: Neil F. Brown, Minneapolis; Keith N. Krier, Tonka Bay; Ranjan K. Nirgude, New Hope, all of Minn.

[73] Assignee: Tennant Company, Minneapolis, Minn.

[21] Appl. No.: 183,727

[22] Filed: Sep. 3, 1980

[51] Int. Cl.[3] ..... A47L 7/00

[52] U.S. Cl. ..... 15/319; 15/320

[58] Field of Search ..... 15/82–87, 15/319, 320, 339, 340

[56] References Cited

U.S. PATENT DOCUMENTS

| | | | |
|---|---|---|---|
| 3,474,483 | 10/1969 | Heidland | 15/319 |
| 3,886,623 | 6/1975 | Landesman et al. | 15/340 X |
| 4,037,289 | 7/1977 | Dojan | 15/320 |

*Primary Examiner*—Chris K. Moore

*Attorney, Agent, or Firm*—Norman P. Friederichs

[57] ABSTRACT

A scrubbing device is provided including a body which is supported on a plurality of wheels which are driven by a hydraulic pump. The scrubbing machine has a squeegee which is hydraulically raised and lowered. The machine is provided with a sensing device adjacent the hydraulic drive pump which senses the flow of the hydraulic fluid and actuates valving to raise the squeegee upon reverse movement of the scrubber and lower the squeegee upon forward movement of the scrubber.

17 Claims, 3 Drawing Figures

Figure I
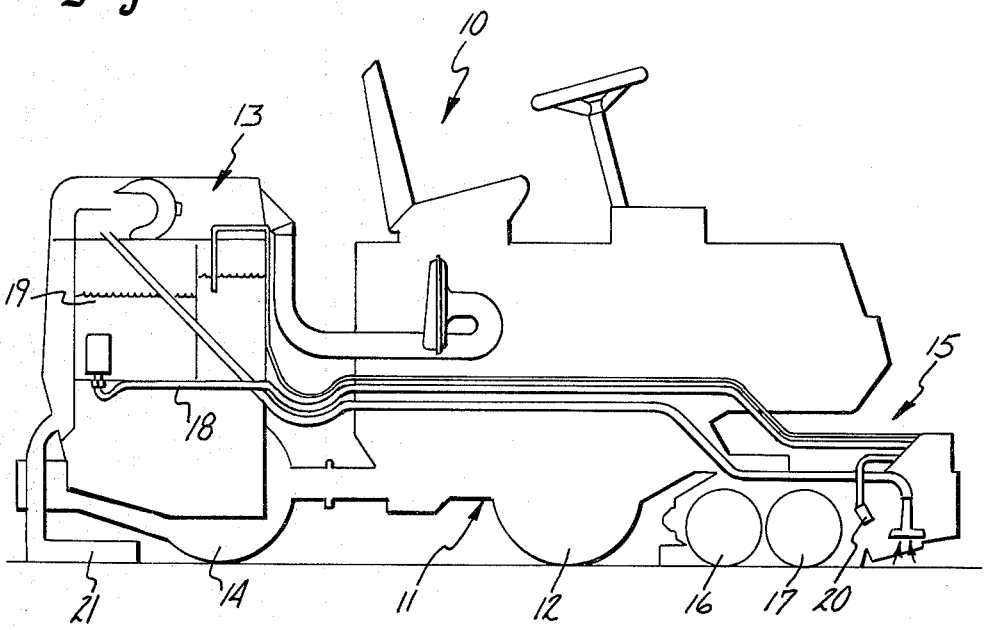
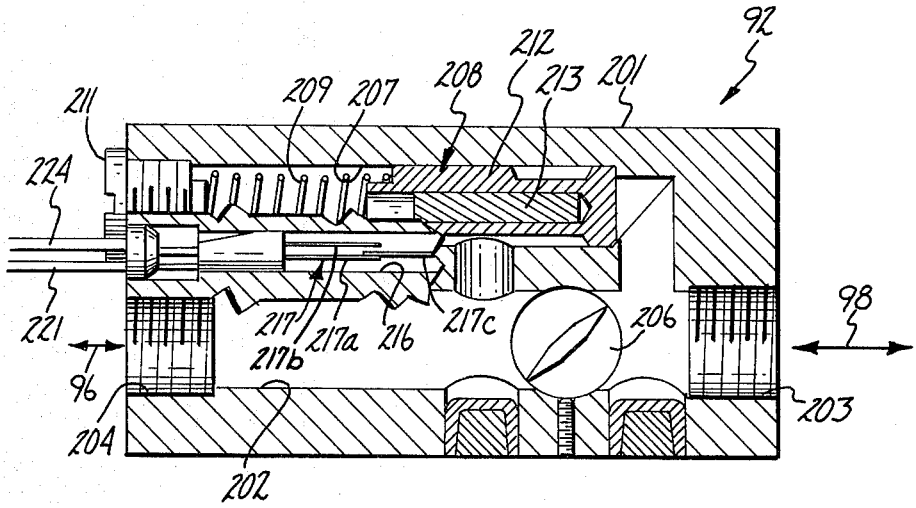
Figure II

Figure III
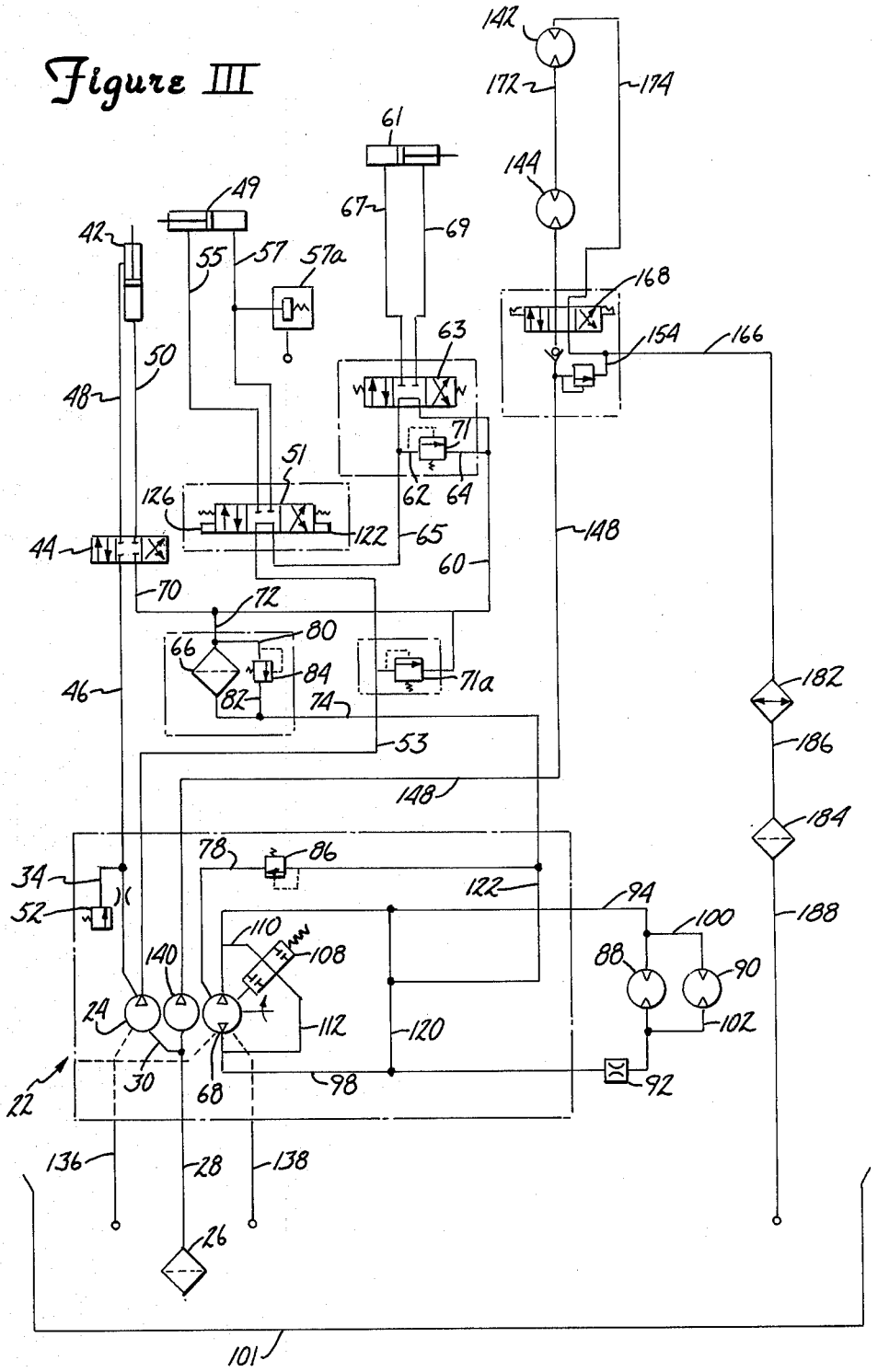

SCRUBBER WITH HYDRAULIC SQUEEGEE LIFT

BACKGROUND OF THE INVENTION

This invention relates to a scrubbing machine and, more particularly, to a hydraulically operated scrubbing machine with automatic squeegee lift during movement in reverse.

Scrubbing machines have been known for some time. Such scrubbing machines have generally included a body structure with suitable support wheels, a scrubbing solution supply, scrubbing brushes and a vacuum squeegee. Previously, the power source of these machines was often electrically driven or gasoline driven. Such machines have operated using gears or pulleys in communication with the drive shaft. In some instances, the scrubbing machines have been hydraulically powered. Scrubbing machines have generally included a squeegee for collecting and lifting scrubbing solution from the floor or surface. It is recognized that squeegee units may be damaged if the squeegee is not raised or lifted when the machine is moved in reverse. Lift arrangements for the brush unit and the squeegee unit have been known in the past. The previous lifts have generally been designed to lock the brush and squeegee units in the up position for non-scrubbing travel and lock the units in the down position for scrubbing use. This concept was workable, but not without problems. In particular, squeegees were easily broken during short backing operations when the operator failed to raise the squeegee.

SUMMARY OF THE INVENTION

The present invention overcomes problems inherent in previous scrubbing machines by using a hydraulic system to automatically raise and lower the squeegee. The hydraulic system also may be used to assist steering, drive the wheels, rotatably drive the brushes, raise and lower the brush unit and raise and lower the squeegee unit. The hydraulic system uses fewer parts and is less complex than an equivalent prior art gear or pulley system. Consequently, maintenance is simplier and much less time consuming.

Additionally, since hydraulic fluid is essentially incompressible, flow direction is communicated rapidly throughout the hydraulic system. The present invention uses this physical fact by incorporating a fluid flow direction sensing switch for the purpose of sensing a backing maneuver and automatically raising the squeegee unit. This feature is a distinct improvement over prior art devices and essentially eliminates the possibility of squeegee damage.

The present scrubber may include a body which is supported on a plurality of wheels. Certain of the wheels may be hydraulically driven. The scrubber may have suitable solution tanks and nozzles for applying scrubbing solution to the floor surface. The scrubber may have a scrubbing brush for working the solution on the floor. The scrubber may be equipped with steering and various controls. The scrubber has a vacuum squeegee for lifting the scrub water from the floor surface. The squeegee is operated in a lowered position when picking up scrubbing solution. The squeegee is lifted by hydraulic mechanism when in a traveling mode. The hydraulic mechanism may include a flow sensing device which recognizes the direction of flow to drive the wheels and automatically lifts the squeegee if the wheels are driven in reverse. The squeegee may be lowered by gravitational force when the wheels are driven forwardly in a normal operating mode. The scrubber may include mechanism for manually locking the squeegee in the raised position.

BRIEF DESCRIPTION OF THE DRAWINGS

The details of the invention will be explained with reference to the accompanying drawings, in which:

FIG. I is a side diagramatic view of the scrubbing device;

FIG. II is a side, cross-sectional view of the fluid flow sensing switch; and

FIG. III is a schematic diagram of the hydraulic control system.

DESCRIPTION OF THE PREFERRED EMBODIMENT

Referring now to the drawings wherein like reference numerals designate identical or corresponding parts throughout the several views, FIG. I shows diagrammatically a scrubbing device 10.

The present scrubbing machine 10 may be an articulated vehicle having a forward power section 11 supported on a plurality of wheels 12 and a rear tank section 13 also supported on a plurality of wheels 14. The wheels 12 may be hydraulically driven. The scrubber power section 11 supports a scrubber head section 15 having a pair brushes 16 and 17 which are rotatably driven as hereinafter described for working the scrubbing solution on the floor or surface being scrubbed. A scrubbing solution supply line 18 extends from tank 19 in section 13 to the nozzles or spreader bar 20 which applies scrubbing solution to the floor or surface to be scrubbed. The scrubbing machine 10 has a squeegee 21 carried by the rear tank section 13. The scrubbing machine 10 is hydraulically operated with the squeegee 21 and the scrubber head section 15 being adapted for raising and lowering. The squeegee 21 is adapted for automatic raising as hereinafter described when the machine 10 is placed in reverse.

The hydraulic system components may be variously located since hoses may easily be extended, shortened, and variously bent to conform to the different component locations. The critical aspect of a hydraulic system is, of course, the pressure integrity of the hoses, connections, and components. Hence, the hydraulic system is shown schematically in FIG. III.

The transmission pump 22 (FIG. III) is enclosed by phantom lines and may be a commercially available unit such as a Vickers TAI5V2010P. It consists of a plurality of hydraulic pumps and valves variously connected by hydraulic lines. Hydraulic pump 24 draws reservoir fluid through filter 26 and lines 28 and 30. Pump 24 sends fluid to power steering cylinder 42 through three-position, four-way valve 44 via lines 46, 48 and 50. Pressure is regulated in the power steering circuit by relief valve 52 connected to line 46 by line 34.

Hydraulic pump 24 also pumps fluid to squeegee lift cylinder 49 through solenoid three-position, four-way valve 51 via lines 53, 55 and 57. The exhaust fluid from valve 51 then flows to lift cylinder 61 for scrubber head section 15 through manually operated three-position, four-way valve 63 via lines 65, 67 and 69. Pressure is regulated in the squeegee lift circuit by relief valve 71*a* in line 53. Pressure is regulated in scrubber head lift circuit by relief valve 71 connected to lines 65 and 60 by lines 62 and 64. Hydraulic fluid is exhausted from both the power steering circuit and the squeegee lift and head lift circuits through filter 66 to variable-pressure, scrubbing device drive pump 68 via lines 60, 70, 72, 74, 76 and 78. Pressure is regulated across filter 66 by adjustable relief valve 84 via lines 80 and 82. Pressure is regulated in pump 68 inlet line 78 by relief valve 86.

Scrubbing device drive pump 68 moves fluid in either a forward or a reverse direction through parallel-connected, reversibly-driven, wheel motors 88 and 90 and fluid flow direction sensing switch 92. The wheel motors 88 and 90 may drive wheels 12. Pump 68 is connected to motor 88 by line 94 on one side and lines 96 and 98 through flow switch 92 on the other side. Motor 90 is connected in parallel with motor 88 by lines 100 and 102. Fluid flow through flow switch 92 is partially relieved through line 104. Three-position, two-way valve 108 via lines 110 and 112 allows for limited bypass between lines 94 and 98 during intake flow.

Pump 24 may exhaust excess fluid through line 136 to the reservoir 101, while pump 68 may exhaust excess fluid through line 138 to the reservoir 101.

In a completely separate circuit from all previously described hydraulic components, hydraulic pump 140 sends fluid primarily to series connected, forward and rearward brush drive motors 142 and 144. Pump 140 is connected to four-way valve 168 via line 148 to drive brush motors 144 and 142 via lines 170, 172 and 174. Pressure is limited by adjustable relief valve 150 via lines 152 and 154. The fluid returns to line 166 through valve 168.

Fluid returning to the reservoir 101 flows through cooler 182 and filter 184 via lines 166, 186 and 188.

With the exception of flow switch 92, the various components such as pump 68 and motors 88, 90 and the like may be of conventional construction. Valve 92 is illustrated in FIG. II. The valve 92 may include a body portion 201 which may be of cast metal having an internal compartment 202 with threaded openings 203 and 204 for connection to the hydraulic lines 98 and 96, respectively. The compartment 202 serves as a passageway through which hydraulic fluid may move. Compartment 202 may include an adjustable valve 206 which partially closes passage through compartment 202 for purposes hereinafter described. The flow switch 92 includes a second compartment 207 in which a piston 208 is disposed. The piston 208 is biased to the right as illustrated in FIG. II by a coil spring 209. The piston 208 and coil spring 209 are held in place by a threadably engaged screw 211. The piston 208 includes a body portion 212 which carries a magnet 213.

The flow switch 92 includes a third compartment 216 in which is mounted a single pole double throw switch 217. The single pole double throw switch 217 includes a first contact **217*a* and a second contact 217*b*. The switch 217 further includes a movable contact 217*c* which is biased downwardly as illustrated in FIG. II. This bias may be overcome as the contact 217*c* is raised when the magnet of piston 208 is superimposed above the contact 217*c*, thus magnetically attracting the contact 217*c*. The flow switch 92 operates solenoid switches 122 and 126 for movement of the three-position, four-way valve 51 of FIG. III. In other words, when the flow switch 92 is in the position illustrated in FIG. II, electrical contact is provided through electrical conductor 221 to a solenoid 122 of FIG. III thereby shifting the valve leftwardly to permit lowering of the squeegee. If the fluid flow through valve 92 is reversed so that fluid enters at 203 via line 98 as it is when fluid to motors 88 and 90 is reversed, piston 208 is moved leftwardly thereby raising the contact 217*c* into engagement with contact 217*b*. In this case, current flows through contact 224 supplying power to solenoid 126 in FIG. III moving the valve 51 rightwardly thus providing hydraulic flow to cylinder 49 to raise the squeegee. The sensitivity of flow switch 92 may be adjusted by adjustment of valve 206. Limit switches may be provided at each end of the stroke of piston 49 to de-energize the solenoids 126 and 122. Valve 51 may be spring biased to the center position blocking lines 55 and 57**, thereby locking the piston in the particular position. An electrical switch may be provided as a manual over-ride so that the operator may selectively raise the squeegee when traveling from one location to another.

Although not illustrated in detail, the present scrubber may be provided with various other controls.

What is claimed:

1. A scrubbing device, comprising a body structure; front and rear wheel means for movably supporting the body structure; steering means for controlling the direction traversed by the scrubbing device; scrubbing brush means carried by the body for wetting and scrubbing a path; scrubbing brush lift means for raising and lowering the scrubbing brush means; vacuum squeegee means carried by the body and disposed rearwardly of the brush means for picking up scrubbing solution from the wetted path; squeegee lift means for hydraulically raising and lowering the vacuum squeegee means; hydraulic power source means carried by the body, said power source means serving to pump a flow of hydraulic fluid in a first direction for driving said wheel means in a forward direction; said power source means serving to pump said hydraulic fluid in a reverse direction for driving said wheel means in a reverse direction; said power source means further serving to drive said scrubbing brush means, said scrubbing brush lift means, said vacuum squeegee means, and said squeegee lift means; solenoid operated hydraulic valve means for actuating said squeegee lift means and hydraulically powered flow-sensing electrical switch means for driving said solenoid valve means, said hydraulic switch means serving to sense the flow direction of the hydraulic fluid in reverse and to then activate said squeegee lift means.

2. A scrubbing device of claim 1 wherein said flow switch means comprise a hydraulically operated single pole double throw electrical switch.

3. A scrubbing device of claim 2 wherein said flow-sensing switch means includes a reciprocable piston carrying a magnet and wherein said switch is actuated by said magnet.

4. A self-propelled, scrubbing device for applying scrubbing solution to a surface, scrubbing the surface with the solution and retrieving the dirty solution from the surface, said scrubbing device comprising:

a vehicular structure supported on a plurality of wheels;

a hydraulic drive motor carried by said vehicular structure, said drive motor serving to drive at least certain of said wheels;

a hydraulically assisted steering means for directing the scrubbing device;

a hydraulically driven brush means carried by the vehicular structure and disposed substantially forwardly on the vehicular structure for wetting and scrubbing a path on said surface;

a hydraulic brush lift means for raising and lowering the brush means;

a vacuum squeegee means carried by the vehicular structure and disposed substantially rearwardly on the vehicular structure for picking up scrubbing solution from the wetted path;

a hydraulic squeegee lift means for raising and lowering the vacuum squeegee means; and sensing means for detecting reversal of the hydraulic flow from said hydraulic drive motor, said sensing means serving to actuate said hydraulic squeegee lift means whereby the vacuum squeegee means is lowered and raised for forward and rearward movement, respectively.

5. A scrubbing device of claim 4 wherein the sensing means includes a fluid flow direction sensing switch for detecting the direction of the hydraulic fluid flow and to actuate the raising and lowering of the vacuum squeegee means dependent on the direction of the fluid flow.

6. A scrubbing device for scrubbing floor areas comprising:

a vehicle including wheels, steering mechanism, brushes and a squeegee;

a hydraulic power source means for producing a reversible hydraulic fluid flow, said power source means being carried within the vehicle for providing vehicle power, said hydraulic means being adapted for driving the wheels and brushes and for lifting and lowering the squeegee; and sensing means for detecting the reversal of the direction of flow of hydraulic fluid for actuating said means for raising and lowering said squeegee whereby the squeegee is lowered for forward movement and raised for rearward movement of said vehicle.

7. The scrubbing device of claim 6 wherein the sensing means includes an electrical switch.

8. The scrubbing device of claim 6 wherein said sensing means comprises a hydraulic flow-sensing single pole double throw magnetic switch.

9. The scrubbing device of claim 8 wherein said sensing means includes a reciprocable piston carrying a magnet and wherein said switch is activated by said magnet.

10. A scrubbing device, comprising a body structure; front and rear wheel means for movably supporting the body structure; steering means for controlling the direction traversed by the scrubbing device; scrubbing brush means carried by the body for wetting and scrubbing a path; vacuum squeegee means carried by said scrubbing device and disposed rearwardly of the brush means for picking up scrubbing solution from the wetted path; squeegee lift means for raising and lowering the vacuum squeegee means; hydraulic power source means carried by the body, said power source means serving to pump hydraulic fluid for driving said wheel means; means for actuating said squeegee lift means and hydraulically powered flow-sensing electrical switch means for driving said actuating means, said hydraulic switch means serving to sense reversal of fluid flow from the hydraulic power source and to then activate said squeegee lift means.

11. A scrubbing device of claim 10 wherein said flow switch means comprise a hydraulically operated single pole double throw electrical switch.

12. A scrubbing device of claim 11 wherein said flow switch includes a reciprocable piston carrying a magnet.

13. A propelled, scrubbing device for applying scrubbing solution to a surface, scrubbing the surface with the solution and retrieving the dirty solution from the surface, said scrubbing device comprising:

a vehicular structure supported on a plurality of wheels;

a hydraulic drive motor carried by said vehicular structure for pumping hydraulic fluid thereby driving said wheels;

driven brush means carried by the vehicular structure for wetting and scrubbing a path on said surface;

brush lift means for raising and lowering the brush means;

vacuum squeegee means carried by the vehicular structure and disposed rearwardly of the brush means on the vehicular structure for picking up scrubbing solution from the wetted path;

hydraulic squeegee lift means for raising and lowering the vacuum squeegee means; and sensing means for detecting reversal of hydraulic flow from said hydraulic drive motor from one flow direction to the other, said sensing means serving to actuate said hydraulic squeegee lift means whereby the vacuum squeegee means is lowered and raised for forward and rearward movement, respectively, of said scrubbing device.

14. A scrubbing device of claim 13 wherein the sensing means includes a fluid flow direction sensing switch for detecting said reversal of hydraulic flow.

15. A propelled, scrubbing device for applying scrubbing solution to a surface, scrubbing the surface with the solution and retrieving the dirty solution from the surface, said scrubbing device comprising:

a vehicular structure supported on a plurality of wheels;

a hydraulic drive motor carried by said vehicular structure for driving said wheels;

a hydraulically driven brush means carried by the vehicular structure for wetting and scrubbing a path on said surface;

hydraulic brush lift means for raising and lowering the brush means;

vacuum squeegee means carried by the vehicular structure and disposed rearward of the brush means on the vehicular structure for picking up scrubbing solution from the wetted path;

hydraulic squeegee lift means for raising and lowering the vacuum squeegee means; and sensing means for detecting hydraulic fluid flow capable of producing rearward movement of said scrubbing device, said sensing means serving to actuate said hydraulic squeegee lift means whereby the vacuum squeegee means is automatically raised for rearward movement of said scrubbing device.

16. A scrubbing device of claim 15 wherein the sensing means includes a fluid flow direction sensing switch for sensing the direction of the hydraulic fluid flow and thereby detecting forward and rearward movement of the scrubbing device, the vacuum squeegee means being automatically lowered for forward movement and automatically raised for rearward movement.

17. A scrubbing device of claim 16 wherein said sensing means includes a reciprocable piston carrying a magnet and wherein said switch is acutated by said magnet.

* * * * *